US006672313B2

(12) United States Patent
Battaglia et al.

(10) Patent No.: US 6,672,313 B2
(45) Date of Patent: Jan. 6, 2004

(54) HAIR STYLING BRUSH WITH INTEGRAL MISTING DEVICE

(76) Inventors: Anthony Battaglia, 3094 SE. Ranch Acre Cir., Jupiter, FL (US) 33478; Allen E. Edwards, 3466 Consulo Dr., Calabasas, CA (US) 91302; Elissa L. Edwards, 3466 Consulo Dr., Calabasas, CA (US) 91302

( * ) Notice: Subject to any disclaimer, the term of this patent is extended or adjusted under 35 U.S.C. 154(b) by 0 days.

(21) Appl. No.: 10/155,915

(22) Filed: May 28, 2002

(65) Prior Publication Data

US 2003/0221699 A1 Dec. 4, 2003

(51) Int. Cl.[7] ..... A45D 24/22

(52) U.S. Cl. ..... 132/112; 132/226; 401/190; 401/270; 222/192

(58) Field of Search ..... 132/112–116, 148, 132/226; 401/190, 270; 222/162, 192

(56) References Cited

U.S. PATENT DOCUMENTS 2,998,822 A * 9/1961 Birch et al. ..... 401/190
RE25,585 E * 5/1964 Birch et al. ..... 401/190
D309,529 S * 7/1990 Kim ..... D4/116
5,927,290 A * 7/1999 Thiruppathi ..... 132/116
6,257,246 B1 * 7/2001 Kan ..... 132/112

* cited by examiner

*Primary Examiner*—Kevin Shaver
*Assistant Examiner*—Stephanie Willatt
(74) *Attorney, Agent, or Firm*—Oltman, Flynn & Kubler

(57) ABSTRACT

A misting styling brush is provided for use with pressurized and non-pressurized cylindrical aerosol sprayers. The misting styling brush includes a handle similar to that of a standard cylindrical hair brush but having a longitudinal interior chamber disposed therein. The aerosol sprayer fits within the handle with an end cap retaining the aerosol sprayer from longitudinal movement once admitted therein. A trigger assembly slides the aerosol sprayer toward the restrained end cap to actuate the pump of the aerosol sprayer to spray a liquid contained therein through a lateral spray hole through the handle. A plurality of interchangeable cylindrical brush assemblies of various outer bristle diameters each include a plurality of bristle groups that extend outwardly from a tubular bristle support member which slides over a brushing portion of the handle. The brush assembly includes a longitudinal slot which mates with a longitudinal key of the brushing portion to prevent rotation thereof and is retained by the end cap. The spray hole and the slot ae radially aligned to permit a spray of the liquid to be emitted between the bristle groups during hair styling. Various diameters of the brush assemblies facilitate styling straight and curly portions of hair styles.

23 Claims, 3 Drawing Sheets

HAIR STYLING BRUSH WITH INTEGRAL MISTING DEVICE

BACKGROUND OF THE INVENTION

1. Field of the Invention

Field: The present invention relates generally to the field of hair styling brushes. More specifically the present invention relates to a circular or radial type hair styling brush that accepts aerosol sprayers and a trigger mechanism for spraying a liquid from between the bristle groups onto the hair and scalp of a user.

2. Description of the Prior Art

Many different types of products have been developed by the medical and cosmetics industries over the years to overcome perceived inadequacies in people's appearances and to enhance their looks such as to appear more youthful. One area of focus is the hair, including many types of hair dyes or colorings, aerosol and pump hair sprays to retain the hair in a desired position, nutrient sprays and products designed to grow new hair or at least to retain the person's remaining hair. Ordinary water is often applied to the hair during cutting and styling to aid in such procedures since wet hair is generally easier to brush or comb and allows the person brushing the hair to have more control over the position of the hair. The growth of hair products and improvements in hair styling have also increased the demand for devices that apply such liquids to the hair and scalp.

Various hair brushes have been developed that include an integral liquid spraying device to facilitate spraying of a desired liquid during hair styling. For example, a hair brush which dispenses a liquid is revealed in Thiruppathi U.S. Pat. No. 5,927,290 issued on Jul. 27, 1999. Thiruppathi teaches a liquid dispensing hair brush which includes a body having an internal chamber with a liquid container disposed in the chamber. A trigger mechanism disposed within the chamber includes a trigger that partially extends from the body and which when depressed drives the liquid container relative to and within the body. A pump disposed in the container dispenses liquid from the container through a spray nozzle when the container is driven by the trigger mechanism. The pump and container are disposed in the head portion of the brush such that the pump stroke may be relatively short. The container may be removable and replaceable or refillable. However, since the hair brush is not a cylindrical styling brush, many hair styling procedures cannot be undertaken using the hair brush such as effective curling. Also, the bristled portion of the hair brush cannot be interchanged to provide the proper size for specific areas of the hair being styled, such as for straight hairstyles and curled hairstyles.

A device used to treat a scalp condition called cradle cap in infants is revealed in Muldoon U.S. Pat. No. 6,213,129 issued on Apr. 10, 2001. Muldoon teaches a device which includes a contoured handle having an internal cavity for containing a liquid such as baby oil. A comb and an opposed hair brush are attached to one end of the handle with a retractable rubber applicator operated by a switch is slidably disposed therewithin operated by a switch on the exterior of the handle. A spray head assembly is attached to an opposite end of the handle having a spray nozzle and trigger for pumping liquid from a storage chamber within the handle. However, since the hair brush is not a cylindrical styling brush, the same inherent shortcomings as Thiruppathi are present, though the presence of a comb may provide slightly more flexibility in doing straight, non-curled styling procedures.

A combined hair brush and aerosol spray device for using a brush and hair spray of an aerosol spray can in one hand is revealed in DeVincentis U.S. Pat. No. 4,557,619 issued on Dec. 10, 1985. DeVincentis teaches a device in the form of a brush which includes a hollow generally cylindrical core with bristles extending radially outwardly therefrom. The core is attached to a base which is detachably mountable to the aerosol spray can. A nozzle assembly having a plurality of nozzles in mutual communication is centrally disposed within the cylindrical core in communication with the nozzle of the aerosol spray can. A spray of hair spray is activated using a trigger lever disposed adjacent to the base of the brush, or using an extension of the nozzle assembly that protrudes beyond the cylindrical core of the brush. However, since the hair brush is only useable with pressurized aerosol spray cans of the small 2.4 ounce size, other types of liquids not available in such spray cans cannot be used. Likewise, the can is gripped during use of the device, providing a cold, non-contoured surface for gripping that would not be comfortable for the user.

A spray brush for simultaneous use with a hand-held hair dryer is revealed in Recchelbacher U.S. Pat. No. 4,934,855 issued on Jun. 19, 1990. Recchelbacher teaches a spray brush which includes a brush head having a generally flat panel formed with a number of holes therethrough, and a plurality of laterally projecting fingers with respective notches therebetween. A tubular handle of the brush forms a reservoir for a hair styling liquid. A manually actuatable pump mechanism pumps the styling liquid from the reservoir through a nozzle reciprocally disposed in a longitudinal slot formed in the panel. The spray brush may be held in one hand with a hair dryer held in the stylist's other hand so that the hair styling composition can be directed onto a person's head while air from the hair dryer is simultaneously directed through tie notches. However, since the hair brush is not a cylindrical styling brush, the same inherent shortcomings as Thiruppathi and Muldoon are present.

A gel dispensing hair brush for automatically dispensing hair styling gel from a plurality of hollow bristles is revealed in Asfur U.S. Pat. No. 6,022,163 issued on Feb. 8, 2000. Asfur teaches a hair brush which includes a handle portion having an open end and a closed end, with an elongate cavity therein. A brush portion is attachable to the open end of the handle portion with a reservoir in communication with the elongate cavity. A bottom wall of the brush portion has a plurality of spaced hollow bristle members in communication with the reservoir. An end portion of the brush portion is attachable to the closed end of the handle portion and includes a direct current motor for rotating a shaft and piston assembly disposed in the elongate cavity to dispense gel from the elongate cavity through the hollow bristles. However, since the hair brush is designed specifically for styling gels which are rather viscous, liquids would not be useable therein, flowing freely and uncontrollably from the ends of the bristles. Also, since the hair brush is not a cylindrical styling brush, the same inherent shortcomings as Thiruppathi, Muldoon, and Recchelbacher are present.

It is thus an object of the present invention to provide a misting styling brush in the form of a cylindrical styling brush which sprays a mist of liquid as a tool for busy women who need a quick hair fix and cannot take the time to do a full style.

It is another object of the present invention to provide a misting styling brush having interchangeable large and small cylindrical brushes, the large size for straight hairstyles and the small size for more curl and direction.

It is a still further object of the present invention to provide a misting styling brush which gives professional hair stylists and consumers the option of doing hair stylings from beginning to end or spot styling without having to re-wet the hair.

It is still another object of the present invention to provide a misting styling brush that utilizes one hundred percent natural bristles, which absorbs the natural oils from the scalp and disperses the oils through the hair, conditioning and protecting hair from damage.

It is another object of the present invention to provide a misting styling brush housing a refillable or disposable mist spray bottle that pumps out over two hundred metered puffs of spray of liquid.

It is finally an object of the present invention to provide such a misting styling brush which has a sectioning tip at one end of the handle that flips out to section the hair, allowing control of the amount of hair to be styled, and then folds back into the handle protecting the tip from damage.

SUMMARY OF THE INVENTION

The present invention accomplishes the above-stated objectives, as well as others, as may be determined by a fair reading and interpretation of the entire specification.

A misting styling brush is provided for use with pressurized and non-pressurized cylindrical aerosol sprayers. The aerosol sprayers are of the type having a cylindrical container containing a liquid to be sprayed from the aerosol sprayer, a dispensing device connected to the container for effecting movement of the liquid from the container through an outwardly spring biased tubular outlet stem by linear actuation of the stem and a push button connected to the stem having an internal conduit for receiving the liquid under pressure from the stem and producing a fine spray of the liquid at a spray orifice at a generally right angle to the stem. The misting styling brush includes a handle assembly having a gripping portion and a brush portion, and having a longitudinal interior chamber disposed therein. A circular cross-section portion of the interior chamber extends longitudinally inwardly through the brush portion having of an inner diameter and length sufficient to completely receive the aerosol sprayer therein with the push button retained in the brush portion. The handle is adapted to retain the push button in a stationary position during use with the spray orifice radially aligned and inwardly disposed from a spray outlet hole of the handle assembly leading outwardly between the bristle groups. The dispensing device and attached container may move along a longitudinal axis of the aerosol sprayer to reciprocably actuate the stem of the dispensing device. A brush assembly includes a plurality of bristle groups that extend outwardly from the brush portion of the handle assembly. The brush assembly has a spray outlet hole that extends radially aligned with the spray outlet hole of the handle assembly, the bristle groups being arranged so as not to obstruct the spray outlet holes. A trigger assembly is connected to the handle assembly intermediate respective ends thereof having a trigger member movably connected to the handle assembly. The trigger assembly is operatively associated with the aerosol sprayer when inserted within the longitudinal interior chamber to urge the container longitudinally upon application of inwardly-directed pressure thereto to actuate the push button to emit the fine spray of the liquid at the spray orifice through the bristle groups at generally right angle to the stem. The misting brush operates by a user depressing the trigger inwardly into the handle assembly using a thumb of the user. This causes the fine spray of the liquid to be emitted at the spray orifice outwardly through the spray outlet holes of the handle assembly and the brush assembly onto a person's hair.

The misting styling brush preferably has a brush assembly comprising a fully cylindrical brush having bristle groups substantially three-hundred-sixty degrees radially therearound, wherein the handle assembly and brush assembly that are adapted to be separable from one another. A hair pick is preferably movably connected to the handle assembly having an open position wherein the hair pick extends away from the handle assembly to allow sectioning and control of an amount of hair to be styled, and a closed position closely adjacent the handle assembly wherein the pointed pick does not extend away from the handle assembly. The misting styling brush preferably includes an end cap that assembles to the handle assembly adapted to retain the push button in a stationary position during actuation of the trigger.

BRIEF DESCRIPTION OF THE DRAWINGS

Various other objects, advantages, and features of the invention will become apparent to those skilled in the art from the following discussion taken in conjunction with the following drawings, in which.

DETAILED DESCRIPTION OF THE PREFERRED EMBODIMENTS

Figure 1:
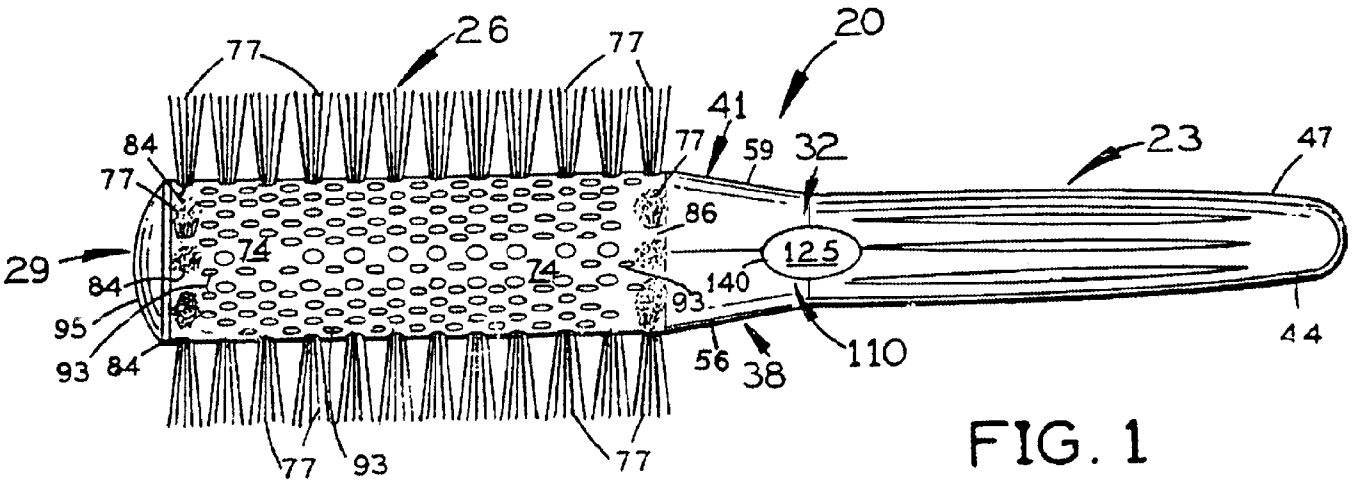
FIG. 1 is a top plan view of a preferred misting styling brush.
Figure 2:
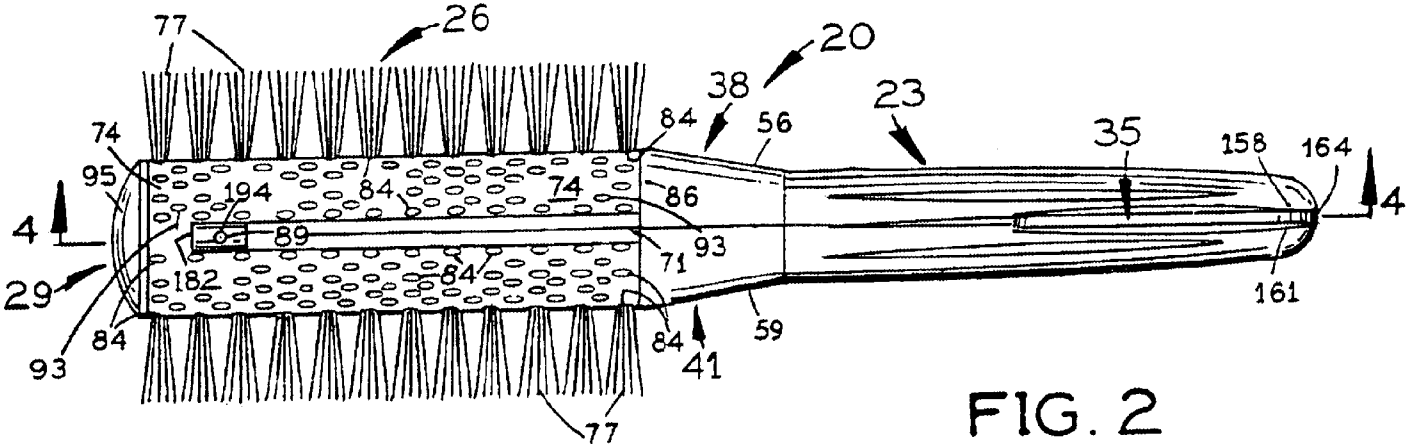
FIG. 2 is a bottom plan view of the misting styling brush.
Figure 3:
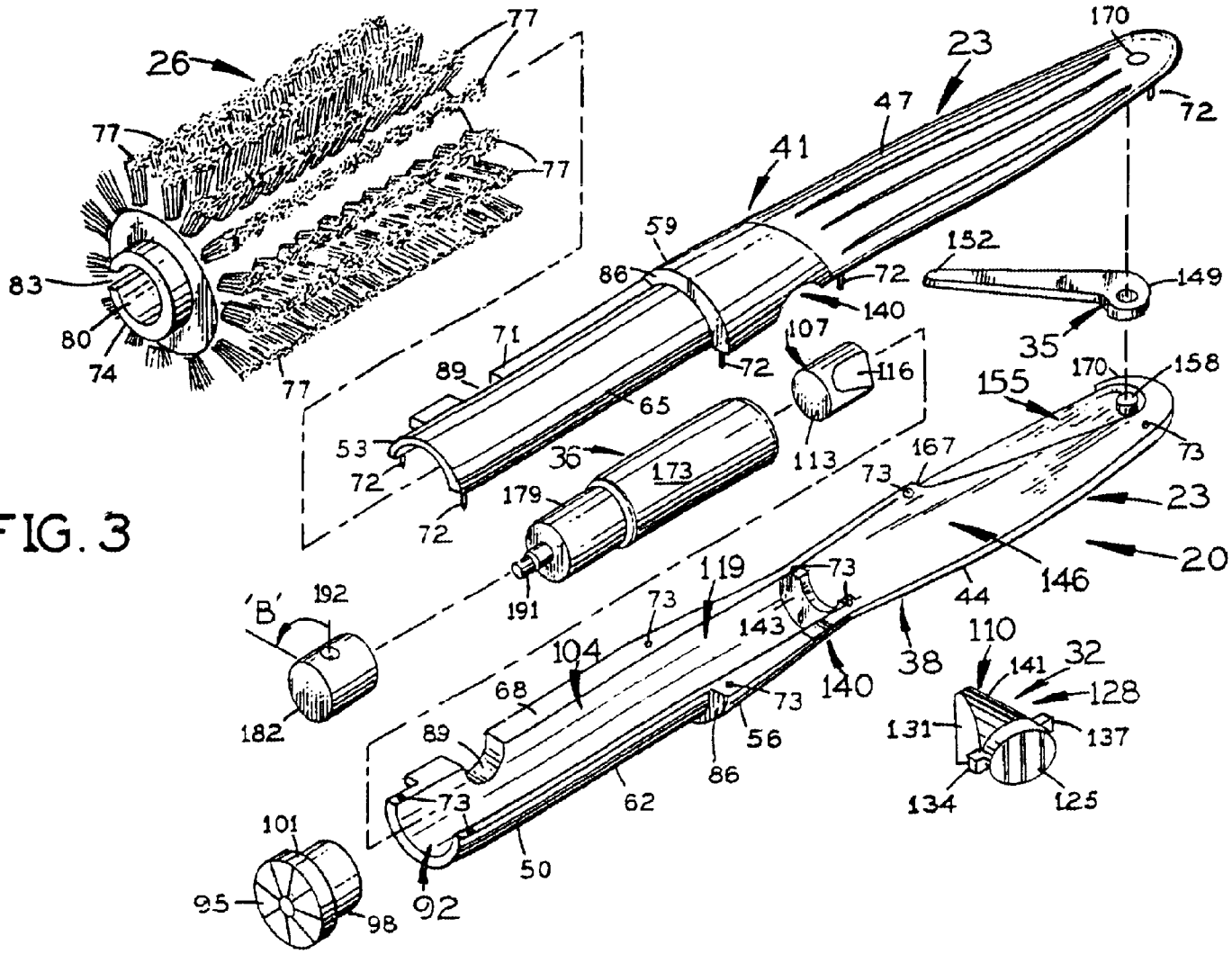
FIG. 3 is an exploded view of the misting styling brush shown in partial longitudinal section, with the push button rotated ninety degrees to show the spray orifice.

As required, detailed embodiments of the present invention are disclosed herein, however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various FIGURES are designated by the same reference numerals.

PREFERRED EMBODIMENT

Referring to FIGS. 1–4, a preferred misting styling brush 20 is disclosed. Misting styling brush 20 includes a handle assembly 23, at least one brush assembly 26, an end cap 29, a trigger assembly 32, and a sectioning tip or a hair pick 35, the misting styling brush being for use with standard pressurized and non-pressurized cylindrical sprayers 36.

The handle assembly 23 includes respective left and right housing halves 38 and 41 that are preferably made of a high impact plastic such as by injection molding. The left and right housing halves 38 and 41 include respective ribbed gripping portions 44 and 47, and keyed cylindrical portions 50 and 53 interconnected by respective tapered portions 56 and 59. The keyed cylindrical portions 50 and 53 include respective half cylinders 62 and 65 with dependent radially extending half keys 68 and 71 that extend longitudinally from the respective tapered portions 56 and 59 most of the length of the respective half cylinder 62 and 65. The left and right housing halves 38 and 41 are interconnected by a plurality of pins 72 which extend from right housing half 41 that are snugly received in mating pin receptacles 73 of left housing half 38.

The brush assembly 26 includes a tubular bristle support member 74 and a plurality of individual bristles or preferably bristle groups 77 that extend radially therefrom. The bristle support member 74 is made of the same material as the handle assembly 23. The bristle groups 77 are preferably made of 100% natural bristles such as boar's hair bristles, which are superior to nylon bristle, as natural bristles absorb the natural oils from the scalp and disperses the oils through the hair, conditioning and protecting it from damage keeping it healthy. The bristle support member 74 includes a longitudinal bore 80 that extends completely through bristle support member 74, being sized to closely fit around the half cylinders 62 and 65 when assembled together. A longitudinal key receiving slot 83 of such a width as to closely receive the half keys 68 and 71 extends most of the length of bristle support member 74. The bristle groups 77 are adhesively or otherwise secured within respective radial bores 84 of the bristle support member 74. The bristle support member 74 assembles over the keyed cylindrical portions 50 and 53 and abuts a shoulder 86 formed by the assembled tapered portions 56 and 59. The length of bristle support member 74 is substantially the same as that of the keyed cylindrical portions 50 and 53. The length of the half keys 68 and 71 is substantially the same as that of the key receiving slot 83. A spray outlet hole 89 extends radially inwardly through the half keys 68 and 71 and the half cylinders 62 and 65 into a longitudinal interior chamber 92 formed by the assembled left and right housing halves 38 and 41. The radial bores 84 immediately adjacent the spray outlet hole 89 are longitudinally displaced so as to create a radial spray opening 93 between adjacent bristle groups 77 for unobstructed spraying.

Preferably two or more interchangeable brush assemblies 26 supplied each utilizing a bristle support member 74 but having bristle groups 77 of differing lengths such that each brush assembly 26 have a different outer diameter. The large diameter is for straight hairstyles and the smaller diameter brush assembly 26 is for more curl and direction. The multiple sizes of brush assemblies 26 give the professional hair stylist and consumer the option of doing hairstyles from beginning to end or spot styling areas of hair style without having to re-wet the hair and start from the beginning. The lengths of the bristle groups 77 of each brush assembly 26 can also be varied along the length or radially about the bristle support member 74 for specific styling applications.

The brush assembly 26 is retained to the handle assembly 23 using the end cap 29, which comprises a rounded head 95, a dependent cylindrical plug 98 having an end wall 100, and a shoulder 101 therebetween. The end cap 29 is made of the same material as the handle assembly 23. End cap 29 is preferably hollowed out so as to limit the weight thereof. Plug 98 is sized so as to closely fit within a bore 104 that defines a portion of the interior chamber 92, either removably pressfitting or snap fitting therein, with the shoulder 101 abutting the handle assembly 23 and the brush assembly 26 for retention together. Bore 104 is sized so as to closely slidably receive the cylindrical sprayer 36. The outer diameter of the head 95 is the same as that of bristle support member 74. The handle assembly 23, brush assembly 26, and end cap 29 assembled together tightly form substantially the same appearance as a standard cylindrical hair brush in common use today. End cap 29 allows the user to access sprayer 36 in order to replace or refill sprayer 36 after it has been emptied.

The trigger assembly 32 includes a cylindrical actuator member 107 and a trigger 110. The actuator member 107 and trigger 110 are made of the same material as the handle assembly 23. The actuator member 107 includes a flat perpendicular surface 113 and an flat angled surface 116, and closely slidably fits within a middle trigger bore 119 that is coaxial with longitudinal bore 80, a shoulder 122 disposed therebetween. The trigger 110 includes a finger contact portion 125 of an oval cross-section, a dependent actuating portion 128 also of an oval cross-section and having a flat angled surface 131 adapted to matingly engage angled surface 116 of the actuator member 107, and respective front and rear retaining tabs 134 and 137. The trigger 110 fits within a mating oval trigger hole 140 that extends radially inwardly through the ribbed gripping portions 44 and 47, and the tapered portions 56 and 59 into the longitudinal interior chamber 92 formed by the assembled left and right housing halves 38 and 41. The trigger 110 is assembled through the trigger hole 140 by tilting trigger 110 forward such that angled surface 131 is almost longitudinally perpendicularly disposed within interior chamber 92 such that the retaining tabs 134 and 137 fit through the trigger hole 140. The trigger 110 is then tilted rearwardly such that a rear surface 141 contacts an annular wall 143 formed between the middle trigger bore 119 and a handle portion 146 of the interior chamber 92 by the left and right housing halves 38 and 41 and the retaining tabs 134 and 137 engage respective front and rear wall portions 147 and 148 also formed by the left and right housing halves 38 and 41. The actuator member 107 is then inserted within the middle trigger bore 119 such that the angled surface 116 is juxtaposed the angled surface 131 of trigger 110. The trigger 110 is positioned on the handle assembly 23 in a location which is convenient for a user to depress while holding the misting styling brush 20 in-hand. The trigger 110 may be depressed using the user's thumb or a finger.

The hair pick 35 includes an annular base 149 and an integral pointed pick 152 extending tangentially from base 149. The hair pick 35 flips of the handle assembly 23 to section the hair (FIG. 4—Arrow "A"), allowing control of the amount of hair to be styled, and then folds back into the handle assembly 23 protecting it from damage. The hair pick 35 is made of the same material as the handle assembly 23. The hair pick 35 pivotally connects to the handle assembly 23 at a pick slot 155 formed therein, the annular base 149 being pivotally disposed about respective cylindrical studs 158 and 161 that are coaxial of the left and right housing halves 38 and 41. The hair pick 35 pivots outwardly from the slot 155 from a closed position wherein the pointed pick 152 is flush with the ribbed gripping portions 44 and 47 of the handle assembly 23 to an open position wherein the hair pick 35 is rotated one-hundred-eighty degrees with the pointed pick 152 pointing rearwardly away from the brush assembly 26. The pointed pick 152 contacts the ribbed gripping portions 44 and 47 at an end 164 of the slot 155 to stop the rotation of the hair pick 35 in the open position, and contacts an opposite end 167 of the slot 155 to stop rotation of the hair pick 35 in the closed position. The hair pick 35 can be frictionally or otherwise retained in the open and closed positions. A hanging hole 170 extends coaxially through the studs 158 and 161 of the assembled handle assembly 23 for hanging the misting brush 20 such as from a hook or wire.

The sprayer 36 includes a cylindrical container 173 containing a liquid 176 to be sprayed from the misting brush 20, a dispensing device 179 comprising a valve for pressurized containers 173 or pump for non-pressurized containers 173, and a push button 182 (Shown rotated ninety degrees in FIG.

3—Arrow "B"). The dispensing device 179 is of standard design having an internally threaded portion (not shown) which threadably connects to an upper externally threaded portion (not shown) of the container 173 for releasing pressurized liquid 176 from container 173 or for pumping the liquid 176 therefrom for non-pressurized containers 173 through an attached tube (not shown) by reciprocally depressing and releasing an outwardly spring biased tubular pump stem 191 using the attached push button 182. Dispensing device 179 may be any of a variety of manual valves, or pumps known in the art that operate to dispense relatively small amounts of liquid with a short pump stroke. Preferably pushing the trigger 110 pumps out one metered puff of spray, with over two hundred metered sprays of liquid before needing refilled, such liquids as mist styling and moisturizing liquids. The liquid 176 flows through an internal conduit (not shown) of the push button 182 and exits as a fine mist through a spray orifice 192. The sprayer 36 slides into the bore 104 against the annular wall 143 and the end cap 29 replaced into the bore 104. The end wall 100 of end cap 29 abuts the push button 182 to retain from longitudinal movement.

Figure 4:
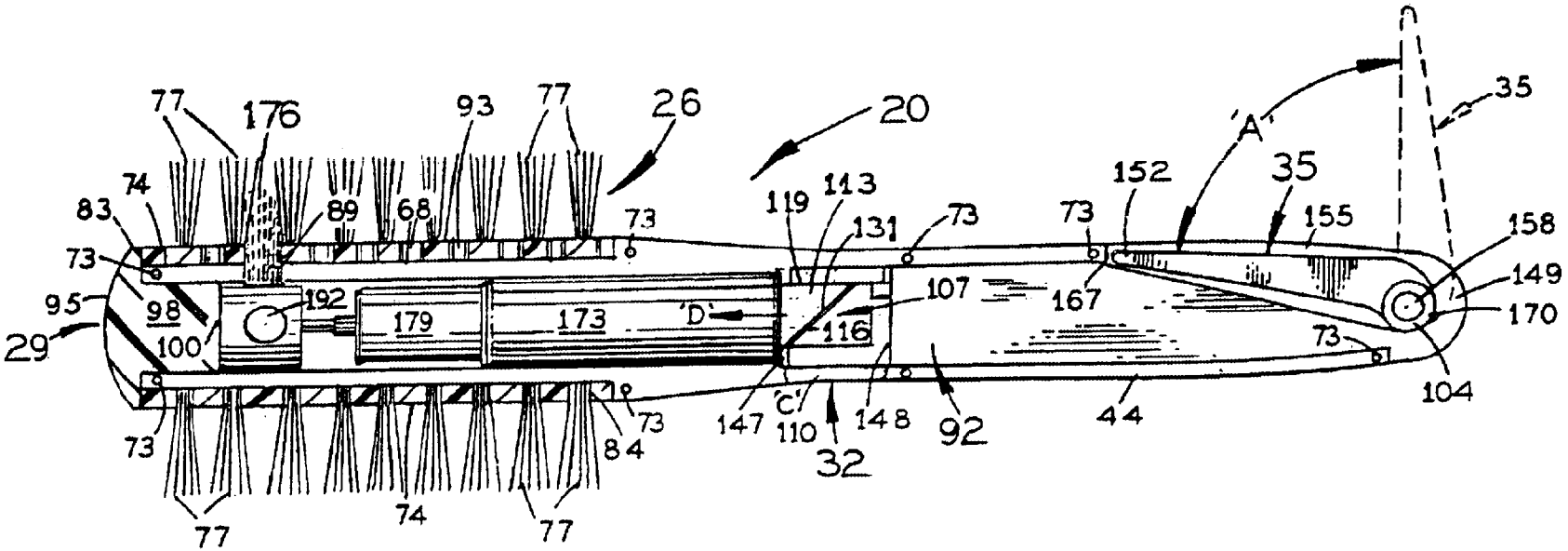
FIG. 4 is a lateral sectional view of the misting styling brush taken on the line 4—4 of FIG. 2.

The misting brush 20 is operated by by the user pressing the finger contact portion 125 using their thumb or finger which drives the trigger 110 into handle assembly 23 (FIG. 4—Arrow "C"). This causes the angled surface 131 to push against and slide along the angled surface 116 of actuator member 107 which slides in the middle trigger bore 119 into container 173 (FIG. 4—Arrow "D") causing forward movement thereof and of attached dispensing device 179 in handle assembly 23 toward the push button 182 which is restrained from moving by contacting the end wall 100 of the end cap 29. This causes the pump stem 191 to depress into dispensing device 179 moving liquid 176 to be sucked from container 173 through the tube, out through spray orifice 192 of push button 182, and through the spray outlet hole 89 of the half keys 68 and 71 and half cylinders 62 and 65, and the key receiving slot 83 a portion of which forms a spray outlet 194 of the bristle support member 74. Trigger 110 returns to the unactuated position when thumb pressure is released therefrom by spring bias of the dispensing device 179. Container 173 may be removed when empty and refilled or replaced with another container 173. Since trigger 110 is not part of the sprayer 36, container 173 may be removed from handle assembly 23 simply by removing end cap 29 and removing sprayer 36. The container 173 may be disassembled from sprayer 36, refilled, and replaced in handle assembly 23 with the spray orifice 192 of push button 182 aligned with the spray outlet hole 89 of handle assembly 23. A frictional or snap fit connection holds the end cap 29 to handle assembly 23.

Numerous modifications can be made to the misting styling brush of the present invention while staying within the same inventive concept. For example, while the configuration of the handle assembly shown has been found convenient for hair stylists to hold in-hand, the handle assembly may be varied into a variety of shapes that fit differently sized hands. Also, while the trigger is shown centrally located on the handle assembly opposite the direction of spraying, the trigger may by located differently in another location that is convenient for a user to depress while holding brush in one hand. Likewise, while the misting styling brush shown has interchangeable large and small cylindrical brushes, other sizes of cylindrical brushes may be used, including those cylindrical brushes which have bristles of varying lengths so as to produce an outer bristle end surface that is not a pure cylinder, though the bristles extend radially for substantially three-hundred-sixty degrees. Finally, the end cap may be replaced by a fixed stop wall and the aerosol sprayer enter the handle assembly through an opening exposed when the brush assembly is removed. The brush assembly may then be retained to the handle assembly frictionally, using clips, using mating projections and detents, or otherwise retained.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teaching herein are particularly reversed especially as they fall within the breadth and scope of the claims here appended.

We claim:

1. A misting styling brush for use with pressurized and non-pressurized cylindrical sprayers of the type having a cylindrical container containing a liquid to be sprayed from the sprayer, a dispensing device connected to the container for effecting movement of the liquid from the container through an outwardly spring biased tubular outlet stem by linear actuation of the stem, and a push button connected to the stem having an internal conduit for receiving the liquid under pressure from the stem and producing a fine spray of the liquid at a spray orifice at a generally right angle to the stem, the misting styling brush comprising:

a handle assembly having a gripping portion and a brush portion, and having a longitudinal interior chamber disposed therein, a circular cross-section of said interior chamber extending longitudinally inwardly through said brush portion and having of an inner diameter and length sufficient to completely receive the sprayer therein with the push button retained in said brush portion, said handle being adapted to retain the push button in a stationary position during use with the spray orifice radially aligned and inwardly disposed from a spray outlet hole of said handle assembly leading outwardly between a plurality of bristle groups, while the dispensing device and attached container may move along a longitudinal axis of the sprayer to reciprocally actuate the stem of the dispensing device;

a brush assembly which includes said bristle groups that extend outwardly from the brush portion of the handle assembly, said brush assembly having a spray outlet hole that is radially aligned with said spray outlet hole of said handle assembly, said bristle groups being arranged so as not to obstruct said spray outlet holes;

a trigger assembly connected to said handle assembly intermediate respective ends thereof, said trigger assembly having a trigger member movably connected to said handle assembly and operatively associated with the sprayer when inserted within said longitudinal interior chamber to urge the container longitudinally upon application of inwardly-directed pressure thereto to actuate the push button to emit the fine spray of the liquid at said spray orifice through said bristle groups at generally right angle to said stem; and wherein the misting brush operates by a user depressing said trigger inwardly into said handle assembly using a thumb of the user to cause the fine spray of the liquid to be emitted at said spray orifice outwardly through said spray outlet holes of said handle assembly and said brush assembly onto a person's hair.

2. The misting styling brush of claim 1, wherein the handle assembly and brush assembly are adapted to be separable from one another.

3. The misting styling brush of claim 2, wherein the brush assembly comprises at least a partially cylindrical brush having a plurality of bristle groups that extend radially therefrom through a predetermined angular radial range.

4. The misting styling brush of claim 2, wherein the trigger is located on the handle assembly radially opposite the spray outlet holes.

5. The misting styling brush of claim 2, including two or more interchangeable brush assemblies, each being adapted primarily for a specific hair styling applications.

6. The misting styling brush of claim 5, wherein two of the interchangeable brush assemblies comprise fully cylindrical brushes having bristle groups substantially three-hundred-sixty degrees radially therearound, being respective large and small bristle diameter brush assemblies, said large bristle diameter brush assembly being adapted for straight hair styles, and said small bristle diameter brush assembly being adapted for a for hair styles requiring more curl and directional control.

7. The misting styling brush of claim 5, wherein individual bristles of the bristle groups comprise natural bristles.

8. The misting styling brush of claim 2, wherein the brush assembly comprises a tubular bristle support member, the plurality of bristle groups which extend radially from a plurality of radial bores in said bristle support member, said bristle support member having a longitudinal bore that extends completely therethrough of a size to closely fit around a mating cylindrical portion of the handle assembly.

9. The misting styling brush of claim 8, wherein the cylindrical portion of the handle assembly includes a key that extends longitudinally therealong, the bristle support member being adapted to assemble over said cylindrical portion with said key, and wherein the bristle support member has a length that is substantially the same as that of said cylindrical portion.

10. The misting styling brush of claim 1, wherein the trigger assembly includes an actuator member and the trigger, said actuator member being of generally circular cross-section closely slidably fitting within a middle trigger bore of said handle assembly that is coaxial with the longitudinal bore, said actuator member having a container contacting surface and opposing longitudinally angled surface, said trigger having a finger contact portion and a dependent actuating portion having a longitudinally angled surface adapted to matingly engage said angled surface of said actuator member, said trigger being disposed within a mating trigger hole extending radially inwardly through said handle assembly into said longitudinal interior chamber, wherein when said finger contact portion is depressed into said handle assembly, said angled surfaces of said trigger and said actuator member engage to cause movement of said actuator member and the sprayer to actuate the push button which is restrained from moving in said handle assembly producing the spray of the liquid at a spray orifice by linear actuation of the stem.

11. The misting styling brush of claim 10, wherein the handle assembly comprises a pair of housing halves which are hollowed such that interconnect together to form the longitudinal chamber.

12. The misting styling brush of claim 11, wherein the housing halves are interconnected by a plurality of pins which extend from one of the housing halves that are snugly received in mating pin receptacles of another of said housing halves.

13. The misting styling brush of claim 10, wherein the finger contact portion and actuating portion of the trigger are of a generally oval cross-section.

14. The misting styling brush of claim 1, wherein the brush assembly comprises a fully cylindrical brush having bristle groups substantially three-hundred-sixty degrees radially therearound.

15. The misting styling brush of claim 1, further comprising a hair pick movably connected to the handle assembly, said hair pick comprising a base disposed within said handle assembly and a pointed pick that extends away from said base, said hair pick having an open position wherein said hair pick extends away from said handle assembly to allow sectioning and control of an amount of hair to be styled, and a closed position closely adjacent said handle assembly wherein said pointed pick does not extend away from said handle assembly.

16. The misting styling brush of claim 15, wherein in the closed position of the hair pick said hair pick is substantially enclosed within the handle assembly.

17. The misting styling brush of claim 15, wherein the handle assembly includes a pick slot formed therein, the hair pick being pivotally connected to said handle assembly at an end of said pick slot wherein said hair pick pivots from the closed position wherein the pointed pick is substantially enclosed within said handle assembly to the open position wherein said pointed pick extends away from said handle assembly.

18. The misting styling brush of claim 17, wherein the hair pick pivots outwardly from the slot from the closed position to the open position wherein said hair pick is rotated between about one-hundred-eighty degrees with said pointed pick pointing rearwardly away from said brush assembly, wherein said pointed pick contacts a portion of said handle assembly at the end of the slot to stop the rotation of said hair pick in the open position, and contacts an opposite end of said slot to stop rotation of said hair pick in the closed position.

19. The misting styling brush of claim 1, further comprising a non-pressurized, refillable sprayer.

20. The misting styling brush of claim 1, further comprising a pressurized, non-refillable sprayer.

21. The misting styling brush of claim 1, further comprising an end cap that assembles to the handle assembly adapted to retain the push button in the stationary position during actuation of the trigger.

22. A misting styling brush, comprising:

a cylindrical sprayer having a cylindrical container containing a liquid to be sprayed from said sprayer, a dispensing device connected to said container for effecting movement of said liquid from said container through an outwardly spring biased tubular outlet stem by linear actuation of said stem, and a push button connected to said stem having an internal conduit for receiving said liquid under pressure from said stem and producing a fine spray of said liquid at a spray orifice at a generally right angle to said stem;

a handle assembly having a gripping portion and a brush portion, and having a longitudinal interior chamber disposed therein, a circular cross-section of said interior chamber extending longitudinally inwardly through said brush portion and having of an inner diameter and length sufficient to completely receive said sprayer therein with said push button retained in said brush portion, said handle being adapted to retain said push button in a stationary position during use with said spray orifice radially aligned and inwardly disposed from a spray outlet hole of said handle assembly leading outwardly between a plurality of bristle groups, while said dispensing device and attached container may move along a longitudinal axis of said sprayer to reciprocally actuate said stem of said dispensing device;

a brush assembly which includes a fully cylindrical brush having said bristle groups that extend outwardly from the brush portion of the handle assembly substantially three-hundred-sixty degrees radially therearound, said brush assembly having a spray outlet hole that is radially aligned with said spray outlet hole of said handle assembly, said bristle groups being arranged so as not to obstruct said spray outlet holes;

a trigger assembly connected to said handle assembly intermediate respective ends thereof, said trigger assembly having a trigger member movably connected to said handle assembly and operatively associated with said sprayer when inserted within said longitudinal interior chamber to urge said container longitudinally upon application of inwardly-directed pressure thereto to actuate said push button to emit the fine spray of the liquid at said spray orifice through said bristle groups at generally right angle to said stem, said trigger assembly including an actuator member and a trigger, said actuator member being of generally circular cross-section closely slidably fitting within a middle trigger bore of said handle assembly that is coaxial with said longitudinal bore, said actuator member having a container contacting surface and opposing longitudinally angled surface, said trigger having a finger contact portion and a dependent actuating portion having a longitudinally angled surface adapted to matingly engage said angled surface of said actuator member, said trigger being disposed within a mating trigger hole extending radially inwardly through said handle assembly into said longitudinal interior chamber, wherein when said finger contact portion is depressed into said handle assembly, said angled surfaces of said trigger and said actuator member engage to cause movement of said actuator member and said sprayer to actuate the push button which is restrained from moving in said handle assembly producing the spray of the liquid at a spray orifice by linear actuation of the stem;

an end cap that assembles to said handle assembly adapted to retain said push button in a stationary position during actuation of the trigger; and wherein the misting brush operates by a user depressing said trigger inwardly into said handle assembly using a thumb of the user to cause the fine spray of the liquid to be emitted at said spray orifice outwardly through said spray outlet holes of said handle assembly and said brush assembly onto a person's hair.

23. The misting styling brush of claim 22, further comprising a hair pick movably connected to the handle assembly, said hair pick comprising a base disposed within said handle assembly and a pointed pick that extends away from said base, said hair pick having an open position wherein said hair pick extends away from said handle assembly to allow sectioning and control of an amount of hair to be styled, and a closed position closely adjacent said handle assembly wherein said pointed pick does not extend away from said handle assembly.

* * * * *